US005277974A

United States Patent [19]

Kubo et al.

[11] Patent Number: 5,277,974

[45] Date of Patent: Jan. 11, 1994

[54] HEAT-BONDABLE FILAMENT AND NONWOVEN FABRIC MADE OF SAID FILAMENT

[75] Inventors: Eiichi Kubo, Uji; Shingo Sasaki, Okazaki, both of Japan

[73] Assignee: Unitaka Ltd., Osaka, Japan

[21] Appl. No.: 24,808

[22] Filed: Mar. 1, 1993

Related U.S. Application Data

[63] Continuation-in-part of Ser. No. 622,332, Nov. 27, 1990, abandoned, which is a continuation of Ser. No. 252,672, Oct. 3, 1988, abandoned.

[30] Foreign Application Priority Data

Oct. 2, 1987 [JP] Japan ..... 62-250409

[51] Int. Cl.[5] ..... D02G 3/00

[52] U.S. Cl. ..... 428/373; 428/374; 428/288; 428/296

[58] Field of Search ..... 428/288, 296, 373, 374, 428/219, 364

[56] References Cited

U.S. PATENT DOCUMENTS

| | | | |
|---|---|---|---|
| 4,469,540 | 9/1984 | Furukawa et al. | 156/181 X |
| 4,506,056 | 3/1985 | Gaylord | 525/244 X |
| 4,563,392 | 1/1986 | Harpell et al. | 428/373 |
| 4,592,943 | 6/1986 | Cancian et al. | 428/373 |
| 4,657,804 | 4/1987 | Mays et al. | 428/212 |
| 4,770,915 | 9/1988 | Nakagaw et al. | 428/374 |
| 4,770,925 | 9/1988 | Uchikawa et al. | 428/219 |
| 4,784,909 | 11/1988 | Emi et al. | 428/357 |
| 4,789,592 | 12/1988 | Taniguchi et al. | 428/373 |
| 4,981,749 | 1/1991 | Kubo et al. | 428/219 |
| 5,143,779 | 9/1992 | Newkirk et al. | 428/37 |
| 5,206,080 | 4/1993 | Tashiro et al. | 428/373 |

*Primary Examiner*—Patrick J. Ryan
*Assistant Examiner*—N. Edwards
*Attorney, Agent, or Firm*—Joseph W. Farley

[57] ABSTRACT

A heat-bondable fiber in the form of a core-sheath type composite fiber comprising a core component and a sheath component which covers the periphery of the core component. The sheath component is formed of copolymer polyethylene consisting of predetermined material and having predetermined properties. The core component is made of a fiber-forming polymer whose melting point is more than 30° C. higher than that of the sheath component. The fineness of the core-sheath type composite fiber is less than 8 deniers. Such heat-bondable fiber provides a nonwoven fabric in which the force of adhesion of the heat-bondable fiber to other dissimilar fibers is high and the hand of the fabric is soft. This nonwoven fabric contains at least 15 percent of the heat-bondable fiber and is heat-treated at a temperature less than the melting point of the core component.

2 Claims, No Drawings

HEAT-BONDABLE FILAMENT AND NONWOVEN FABRIC MADE OF SAID FILAMENT

This is a continuation-in-part of copending application Ser. No. 07/622,332 filed Nov. 27, 1990, now abandoned, which is a continuation of application Ser. No. 07/252,672 filed Oct. 3, 1988, now abandoned.

FIELD OF THE INVENTION

The present invention relates to a core-sheath type composite heat-bondable fiber having superb heat-bondability and a nonwoven fabric made of said fiber.

BACKGROUND OF THE INVENTION

A nonwoven fabric made of composite type heat-bondable fiber has been known, disclosed in Japanese Patent Publication No.61-10583. This nonwoven fabric is obtained by heat-treating a mixture of fibers containing not leas than 25 weight percent of a heat-bondable composite fiber which comprises a first component consisting of 50–100 weight percent of linear low density polyethylene and 50–0 weight percent of polyethylene different therefrom, and a second component in the form of a fiber-forming polymer (polypropylene, polyester, polyamide or the like) exhibiting a melting point which is more than 30t: higher than that of these polyethylenes, the heat-treatment being performed at a temperature above the melting point of said first component but below the melting point of said second component.

The desire of the industry for a nonwoven fabric having a high strength and a soft hand is very high; the composite type heat-bondable fiber disclosed in said Japanese Patent Publication No. 61-10583 is capable of offering a nonwoven fabric having a soft hand. However, it has the drawback that it is lacking in the adhesion to fibers of other materials than polyethylene, in which case it is necessary to increase the amount of heat-bondable fiber, hardly providing a nonwoven fabric which is soft in terms of hand.

DISCLOSURE OF THE INVENTION

An object of the invention is to provide a heat-bondable fiber which is high in adhesion when it adheres to a dissimilar fiber and which is capable of providing a nonwoven fabric having an improved hand.

A heat-bondable fiber according to the invention is a core-sheath type composite fiber comprising:

a core component and a sheath component which covers the periphery of said core component, said sheath component being formed of a copolymer polyethylene consisting of ethylene and at least one member selected from the class consisting of an unsaturated carboxylic acid, a derivative from said carboxylic acid, and a carboxylic acid anhydride, the content of said copolymer component being 0.1–5.0 mole percent, the melt index value being 1–50 g/10 minutes as measured by the ASTM D-1238(E), said core component being made of a fiber-forming polymer having a melting point which is more than 3013 higher than that of the copolymer polyethylene of said sheath component, said core-sheath type composite fiber having a single fiber fineness of less than 8 deniers.

A nonwoven fabric according to the invention, which contains at least 15% of the heat-bondable fiber of the above-described composition, has been heat-treated at a temperature lower than the melting point of said core component.

The copolymer component of ethylene in the invention, as described above, is an unsaturated carboxylic acid, a derivative from said carboxylic acid, or a carboxylic acid anhydride. Coming under the category of such copolymer component are unsaturated carboxylic acids, such as acrylic acid and methacrylic acid; acrylic esters, such as methyl acrylate, ethyl acrylate, butyl acrylate, 2-ethylhexyl acrylate, and 2-hydroxyethyl acrylate; methacrylate esters, such as methly methacrylate, ethyl methacrylate, butyl methacrylate 2-ethylhexyl methacrylate; and unsaturated carboxylic acid anhydrides, such as maleic acid anhydride and itaconic acid anhydride. The copolymer polyethylene of the invention contains one or more such copolymer components; thus, these copolymer components may be suitably combined. Further, the copolymer polyethylene of the invention may be a combination of ethylene and said carboxylic acid compound in alternate, random or block form or mixture of such forms.

The copolymerization ratio of the copolymer component to ethylene is restricted to 0.1–5.0 mole percent with respect to ethylene from the standpoint of physical properties of the copolymer polyethylene. In the case where the copolymerization ratio is less than 0.1 mole percent, the adhesion to other fibers is low as in the case of polyethylene alone, with the result that a nonwoven fabric of low strength can only be obtained. On the other hand, if the copolymerization ratio is greater than 5.0 mole percent, the adhesion to other fibers becomes higher, but the melting point or softening point of the copolymer polyethylene becomes extremely low, which is not desirable from the standpoint of heat resistance when a nonwoven fabric is formed. The reason for restricting the melt index value of the copolymer polyethylene to 1–50 g/10 minutes as measured by ASTM D-1238(E) is that in the case of a copolymer polyethylene whose melt index value is less than 1 g/10 minutes, the fluidity associated with melt spinning is degraded to the extent that a composite fiber cannot be produced unless the spinning speed is drastically decreased. On the other hand, if the melt index value exceeds 50 g/10 minutes, this is not desirable since this decreases the strength of the composite fiber.

It is necessary that the melting point of the core component of the composite type heat-bondable fiber be more than 30° C. higher than the melting point of the copolymer polyethylene of the sheath component. To obtain a fabric satisfactory in strength, it is necessary that the heat-bondable fiber be sufficiently melted in the heat treatment process and that after the heat treatment, the configuration of the composite fiber be sufficiently retained. To this end, the difference in melting point between the core and sheath components must be at least 30° C. If there is a difference of more than 30° C. therebetween, the configuration retention of the composite fiber will be uniform and the sheath component will be melted in the heat treatment process; therefore, heat treatment conditions which provide compatibility between strength and hand for a nonwoven fabric to be produced can be easily selected.

As for the fiber-forming polymer which constitutes the core component, mention may be made of such polymers as linear low density polyethylene, polypropylene, polyester and polyamide, which can be melt-spun.

The composite type heat-bondable fiber in the present invention is a composite fiber having a cross-sectional shape in which copolymer polyethylene covers the fiber-forming polymer. As for the composition ratio, it is preferable that the amount of the copolymer polyethylene in the sheath component be 20–80 weight percent and the amount of the fiber-forming polymer in the core component be 80–20 weight percent. In the case where the amount of the copolymer polyethylene of the sheath component is less than 20 weight percent, the strength of the resulting nonwoven fabric is high but the force of adhesion of a mixture to other fibers for making a nonwoven fabric Is low; thus, only a nonwoven fabric of low strength can be obtained. On the other hand, if the amount of the copolymer polyethylene of the sheath component exceeds 80 weight percent, the force of adhesion in the nonwoven fabric is high but the strength of the fiber itself is low; thus, the nonwoven fabric is of low strength.

The fiber of the invention is a composite fiber whose single fiber fineness is less than 8 deniers. That is, the composite type heat-bondable fiber of the invention is suitable for forming a nonwoven fabric which is required to be particularly soft; thick single fiber would lead to high stiffness and undesirable hand. Therefore, the invention is not directed to thick fibers whose fineness exceeds 8 deniers. In addition, the copolymer polyethylene which is the sheath component may have mixed therewith such a polyolefin as polyethylene or polypropylene or may have added thereto a wetting agent, a delusterant, a pigment, a stabilizer and/or a flame retardant.

The composite type heat-bondable fiber of the invention can be produced by using a composite spinning device known in the art. The melt spinning temperature for the sheath component is 180°–280° C., preferably 190°–250° C., while the melt spinning temperature for the core component may be set according to the conditions for spinning the fiber-forming polymer alone selected as the core component.

The spun, undrawn composite filament may go without a drawing process in the case where its single fiber fineness is less than 8 deniers; however, usually the resulting undrawn filament is drawn to 2–8 times the original length at a temperature which is above the room temperature but below the melting point of the sheath component, to provide a composite type heat-bondable fiber.

In the present invention, a group of fibers for forming a nonwoven fabric is composed of either a composite type heat-bondable fiber of less than 8 deniers or a mixture of said heat-bondable fiber and other fibers with a fineness of less than 8 deniers, said mixture containing at least 15 weight percent of said heat-bondable fibers with respect to the total amount of the mixed fibers. As for said other fibers, it is possible to use any fibers that will neither melt nor greatly shrink during heat treatment for nonwoven fabric production and that satisfy the aforesaid fineness condition. For example, one or two or more members selected from the group consisting of natural fibers such as cotton and wool, semi-synthetic fibers such as viscose rayon and cellulose acetate, and synthetic fibers such as polyolefin fibers such as polyethylene and polypropylene, polyamide fiber, polyester fiber and acrylic fiber may be suitably selectively used in an amount which is less than 85 weight percent with respect to the total amount of the mixed fibers. If the amount of the composite type heat-bondable fiber in the mixed fibers is less than 15 weight percent, this is undesirable as the strength of the nonwoven fabric decreases. The reason why the fineness of other fibers to be mixed with said composite type heat-bondable fiber is restricted to less than 8 deniers is that if a fiber having a fineness greater than this value, it is impossible to obtain a nonwoven fabric of good hand.

As for a method of forming a composite type heat-bondable fiber alone or a mixture of said composite fiber and other fibers into a web, use may be made of known methods used for producing nonwoven fabrics in general, such as carding, air laying, wet paper screening. Then, the resulting group of fibers in web form is heat-treated at a temperature below the melting point of the core component of the composite fiber, whereby a nonwoven fabric is obtained. As for a machine for heat treatment, use may be made of heat treating devices including such dryers as a hot air dryer and a suction drum dryer, and such hot rolls as a flat calender roll and an embossing roll.

Whether the heat-bondable fiber of the invention is used for a nonwoven fabric or it is mixed with other fibers to serve as a binder, a nonwoven fabric of good hand can be obtained since in either case the force of adhesion between fibers is high. For this reason, it has a wide application in covering sheets for disposable diapers and sanitary articles and in the medical field.

DESCRIPTION OF EXAMPLES

The invention will now be described in more concrete with reference to examples thereof. Methods for measuring the tensile strength, compression bending rigidity (an index indicating softness) and weight of nonwoven fabrics referred to in the examples will first be described.

(1) Tensile Strength

The maximum tensile strength of a 30 mm wide and 100 mm long testpiece was measured according to JIS L-1096 Strip Method.

(2) Compression Bending Rigidity (Softness)

A 50 mm×100 mm testpiece was formed into a 50 mm high cylinder having a circumference of 100 mm, and said cylinder placed on a flat plate type load cell was loaded under compression; the maximum compression load applied was measured.

(3) Weight

Determined according to JIS P-8142.

(4) Overall Appraisal

Appraised on the basis of both tensile strength and compression bending rigidity. The appraisal marks used hereinafter are as follows:

Appraisal Marks

○—Good

×—Bad

EXAMPLE 1, COMPARATIVE EXAMPLE 1

Melt extrusion was performed by using as a sheath component copolymer polyethylene which contained 1 mole percent of acrylic acid and whose melt index value measured by ASTM D-1238(9) was 10g/10minutes and whose melting point measured by DSC was 104.6° C. and as a core component polyethylene terephthalate whose intrinsic viscosity ($\eta$) measured in a phenol/tetrachloroethane (weight ratio, 1:1) mixed solvent at 20t was 0.70 and whose melting point measured by DSC was 255° C., and using a composite fiber melt spinning device with a spinneret having 390 holes, at a melting temperature of 230° C. for the copolymer polyethylene and a melting temperature of 285° C. for the polyethylene terephthalate, a single hole delivery rate of 1.5 g/min, the copolymer polyethylene/polyethylene terphthalate composite ratio being 50:50. After cooling, the fiber was taken up at a rate of 1,100 m/min. The resulting composite undrawn filament was drawn at a drawing temperature of 85° C. and a draw ratio of 3.5 times and crimped by a stuffer type crimper, whereupon it was cut into lengths of 51 mm to produce a staple fiber whose single fiber fineness was 3.5 deniers. The properties of the resulting staple fiber are shown in Table 1.

Subsequently, this composite fiber staple was fed to a carding machine to form a web having a weight of 15 g/m$^2$, and the web was then heat-treated at 120° C. by using a suction dryer to form a nonwoven fabric. The properties of the nonwoven fabric obtained are shown in Table 2.

Next, as a comparative example 1, spinning, drawing and crimping of a core-sheath type composite fiber were performed in the same manner as that of Example I by using low density polyethylene whose melt index measured by ASTM D-1238(E) was 10 g/10 minutes and whose melting point measured by DSC was 105° C. as a sheath component instead of using the copolymer polyethylene of Example 1. The properties of the resulting composite heat-bondable fiber are shown in Table 1. Subsequently, said heat-bondable fiber was formed into a nonwoven fabric in a manner similar to that of Example 1. The properties of the nonwoven fabric obtained are shown in Table 2.

TABLE 1

| | Properties of Composite Type Heat-Bondable Fiber | | | | | | | | |
|---|---|---|---|---|---|---|---|---|---|
| | Heat-bondable fiber (sheath component) | | Yarn properties | | | | | | |
| | Copolymer component monomer mole % | Melt index g/10 minutes | Fineness den. | Tenacity g/d | Elongation % | Number of crimps per 25 mm | Crimp percentage % | Elastic crimp percentage % | Residual crimp percentage % |
| Present invention | | | | | | | | | |
| Example 1 | Acrylic acid 1 | 10 | 3.5 | 3.5 | 60 | 18 | 13 | 77 | 11 |
| Example 3 | Acrylic acid 1 | 10 | 3.5 | 3.1 | 68 | 19 | 13 | 78 | 13 |
| Example 8 | Acrylic acid 1 | 10 | 3.5 | 3.5 | 45 | 19 | 16 | 76 | 12 |
| Example 11 | Acrylic acid 3 | 20 | 3.5 | 3.3 | 63 | 18 | 14 | 75 | 11 |
| Example 13 | Maleic anhydride 0.5 | 20 | 3.5 | 3.6 | 62 | 20 | 12 | 77 | 12 |
| Example 14 | Maleic anhydride 0.5 Ethylacrylate 1.5 | 5 | 3.5 | 3.4 | 62 | 18 | 13 | 77 | 11 |
| Comparative example 1 | LDPE | 10 | 3.5 | 3.6 | 60 | 18 | 15 | 75 | 12 |

TABLE 2

| | Properties of nonwoven fabric of 100% heat-bondable fiber | | | | | | |
|---|---|---|---|---|---|---|---|
| | Composition of nonwoven fabric | | | Properties of nonwoven fabric | | | |
| | Core/sheath ratio of heat-bondable fiber: 50/50 | | Heat-treating machine | Weight g/m | Tensile strength g/3 cm | Compression bending rigidity g | Overall appraisal |
| | Sheath | Core | | | | | |
| Present invention | | | | | | | |
| Example 1 | Copolymer polyethylene | PET | Suction drum dryer | 15 | 1100 | 15 | ○ |
| Example 2 | Copolymer polyethylene | PET | Calender roll | 15 | 1500 | 20 | ○ |
| Example 3 | Copolymer polyethylene | PP | Suction drum dryer | 15 | 1100 | 12 | ○ |
| Comparative Example | | | | | | | |
| 1 | LDPE | PET | Suction drum dryer | 15 | 800 | 16 | ○ |
| 2 | LDPE | PET | Calender roll | 15 | 1200 | 20 | ○ |

Note
PET: polyethylene terephthalate
PP: polypropylene
LDPE: low density polyethylene

EXAMPLE 2, COMPARATIVE EXAMPLE 2

Staple fiber consisting of a composite heat-bondable fiber containing a sheath component formed of the copolymer polyethylene obtained in Example 1 and a core component formed of polyethylene terephthalate was fed to a carding machine to form a web having a weight of 15 g/m$^2$, said web being heat-treated by calender rolls comprising a metal hot roll and a rubber roll at a roll temperature of 100° C. and a mix pressure of 35 kg/cm, whereby a nonwoven fabric was obtained. The performance of this nonwoven fabric is shown in Table 2.

As a comparative example 2, a web was produced in the same manner as that of Example 2 by using staple fiber consisting of a composite heat-bondable fiber containing a sheath component formed of the low density polyethylene obtained in Comparative Example 1 and a core component formed of polyethylene terephthalate, said web being then formed into a nonwoven fabric under the calender conditions of Example 2. The performance of the nonwoven fabric obtained is shown in Table 2.

EXAMPLE 3

Melt extrusion was performed by using as a sheath component the copolymer polyethylene used in Example 1 and as a core component polypropylene whose melt flow rate measured by ASTM D-1238(L) was 15 g/10 minutes and whose melting point measured by DSC was 165° C. and using a composite spinning device similar to the one used in Example 1, at a melt spinning temperature of 230° C. for the copolymer polypropylene, a melt temperature of 270° C. for the polypropylene, a single hole delivery rate of 2.0 g/min, the copolymer polyethylene/polypropylene composite ratio being 50:50 by weight. After cooling, the filament was taken up at a rate of 1,100 m/min. The resulting composite undrawn filament was drawn at a drawing temperature of 70° C. and a draw ratio of 3.5 and crimped by a stuffer type crimper, whereupon it was cut into lengths of 51 mm to produce a staple fiber whose single fiber fineness was 3.5 deniers. A nonwoven fabric was formed in the same manner as that of Example 1 by using the staple fiber obtained. The properties of this composite heat-bondable fiber are shown in Table 1 and the properties of the nonwoven fabric are shown in Table 2.

EXAMPLES 4–5, COMPARATIVE EXAMPLES 3–4

Nonwoven fabrics were formed in the same manner as that of Example 1, each by using a mixture of the staple fiber consisting of the heat-bondable fiber of Example 1 and another fiber. As for the mixing ratio, the mixture (Example 4) contained 15 parts of the heat-bondable fiber and 85 parts of PET, and the mixture (Example 5) contained 15 parts of the heat-bondable fiber and 85 parts of polypropylene. The properties of the resulting nonwoven fabrics are shown in Table 3.

For comparison with said Examples 4 and 5, nonwoven fabrics were formed in the same manner as that of Example 1, each by using a mixture of the heat-bondable fiber of Comparative Example 1 and another fiber. As for the mixing ratio, the mixture (Comparative Example 3) contained 20 parts of heat-bondable fiber and 80 parts of PET and the mixture (Comparative Example 4) contained 20 parts of heat-bondable fiber and 80 parts of polypropylene. The properties of the nonwoven fabrics are shown in Table 3.

TABLE 3

| | Properties of nonwoven fabric of mixed fiber | | | | | | | | |
|---|---|---|---|---|---|---|---|---|---|
| | Composition of nonwoven fabric | | | | | Properties of nonwoven fabric | | | |
| | Heat-bondable fiber Core/sheath ratio: 50/50 | | Mixing ratio; heat-bondable fiber/another fiber | Another fiber* | | Weight | Tensile strength | Compression bending rigidity | Overall appraisal |
| | Sheath | Core | | Material | Fineness | g/m$^2$ | g/3 cm | g | |
| Present invention | | | | | | | | | |
| Example 4 | Copolymer polyethylene | PET | 15/85 | PET | 3.0 | 15 | 420 | 8 | ○ |
| Example 5 | Copolymer polyethylene | PET | 15/85 | PP | 3.3 | 15 | 415 | 7 | ○ |
| Comparative Example | | | | | | | | | |
| 3 | LDPE | PET | 20/80 | PET | 3.0 | 15 | 230 | 9 | X |
| 4 | LDPE | PET | 20/80 | PP | 3.3 | 15 | 250 | 8 | X |
| Present Invention | | | | | | | | | |
| Example 6 | Copolymer polyethylene | PP | 20/80 | PET | 3.0 | 15 | 745 | 13 | ○ |
| Example 7 | Copolymer polyethylene | PP | 20/80 | PP | 3.3 | 15 | 730 | 12 | ○ |
| Example 8 | Copolymer polyethylene | N-6 | 20/80 | PET | 3.0 | 15 | 430 | 8 | ○ |
| Example 9 | Copolymer polyethylene | N-6 | 20/80 | PP | 3.3 | 15 | 400 | 7 | ○ |
| Example 10 | Copolymer polyethylene | N-6 | 15/85 | N-6 | 3.0 | 15 | 535 | 6 | ○ |
| Example 11 | Copolymer polyethylene | PET | 20/80 | PET | 3.0 | 15 | 505 | 9 | ○ |
| Example 12 | Copolymer polyethylene | PET | 20/80 | PP | 3.3 | 15 | 500 | 8 | ○ |
| Example 13 | Copolymer polyethylene | PET | 20/80 | PET | 3.0 | 15 | 485 | 9 | ○ |
| Example 14 | Copolymer polyethylene | PET | 20/80 | PET | 3.0 | 15 | 520 | 9 | ○ |
| Example 15 | Copolymer | PET | 20/80 | PP | 3.3 | 15 | 510 | 8 | ○ |

TABLE 3-continued

| Properties of nonwoven fabric of mixed fiber | | | | | | | | | |
|---|---|---|---|---|---|---|---|---|---|
| Composition of nonwoven fabric | | | | | Properties of nonwoven fabric | | | | |
| Heat-bondable fiber Core/sheath ratio: 50/50 | | Mixing ratio; heat-bondable fiber/another fiber | Another fiber* | | Weight | Tensile strength | Compression bending | Overall |
| Sheath | Core | | Material | Fineness | $g/m^2$ | g/3 cm | rigidity g | appraisal |
| polyethylene | | | | | | | | |

Note:
PET: polyethylene terephthalate
LDPE: low density polyethylene
PP: polypropylene
N-6: nylon 6
*The length of another fiber is 51 mm in each case

EXAMPLES 6–7

Nonwoven fabrics were obtained, each by mixing the heat-bondable fiber of Example 3 with another fiber and passing the mixture through a carding machine in the same manner as in Example 1 to form a web, which was then heat-treated by the calender roll method at a roll temperature of 100° C. and a mix pressure of 35 kg/cm in the same manner as that of Example 2. The properties of said nonwoven fabrics are shown in Table 3.

EXAMPLES 8–10

Melt extrusion was performed by using as a sheath component the copolymer polyethylene used in Example 1 and as a core component nylon 6 polymer whose relative viscosity $\eta_{rel}$ measured by an Ostwald viscometer by dissolving 1.0 g of the polymer in 100 cc of 96% concentrated sulfuric acid was 2.6 and whose melting point measured by DSC was 220° C., and by using a spinntret having 390 holes, at a melting temperature of 230° C. for the copolymer polyethylene and a melting temperature of 270° C. for the nylon 6 polymer, a single hole delivery rate of 2.0 g/min, the copolymer polyethylene/nylon 6 polymer composite ratio being 50:50 by weight. After cooling, the filament was taken up at a rate of 1,100 m/min. The resulting composite undrawn filament was drawn at a drawing temperature of 80° C. and a draw ratio of 5.5 and crimped by a stuffer type crimper, whereupon it was cut into lengths of 51 mm to produce a staple fiber whose single fiber fineness was 3.5 deniers. The resulting staple fiber was mixed with another fiber and passed through a carding machine in the same manner as that of Example 1 to form a web, which was then heat-treated at a temperature of 120° C. by a suction drum dryer to provide a nonwoven fabric. The properties of the composite type heat-bondable fiber are shown in Table 1 and the properties of the nonwoven fabrics obtained are shown in Table 3.

EXAMPLES 11–12

Composite type heat-bondable fiber was produced under the same conditions as in Example 1 except using as a sheath component copolymer polyethylene which contained 3 mole percent of acrylic acid and whose melt index measured by ASTM D-1238(E) was 20 g/10 minutes and whose melting point measured by DSC was 96.213. The heat-bondable fiber obtained was mixed with another fiber and the mixture was formed into a web in the same manner as that of Example 1 by a carding machine, said web being then heat-treated at a temperature 120° C. by the suction drum dryer method to provide a nonwoven fabric. The properties of the composite type heat-bondable fiber are shown in Table 1, and the performance of the nonwoven fabrics obtained are shown in Table 3.

EXAMPLE 13

Composite type heat-bondable fiber was produced under the same conditions as in Example 1 except for using as a sheath component copolymer polyethylene which contained 0.5 mole percent of maleic acid anhydride and whose melt index measured by ASTM D-1238(E) was 20 g/10 minutes and whose melting point measured by DSC was 110t. The heat-bondable fiber obtained was mixed with another fiber and the mixture was formed into a web in the same manner as that of Example 1 by a carding machine, said web being then heat-treated at a temperature 125° C. by the suction drum dryer method to provide a nonwoven fabric. The properties of the composite type heat-bondable fiber are shown in Table 1, and the performance of the nonwoven fabrics obtained is shown in Table 3.

EXAMPLES 14–15

Composite type heat-bondable fiber was produced under the same conditions as in Example 1 except for using as a sheath component copolymer polyethylene which contained 0.5 molar percent of acrylic acid anhydride and 1.5 molar percent of ethylacrylate serving as copolymer components of ethylene and whose melt index measured by ASTM D-1238(E) was 5 g/10 minutes and whose melting point measured by DSC was 107° C.. The heat-bondable fiber obtained was mixed with another fiber and the mixture was formed into a web in the same manner as in Example 1 by a carding machine, said web being then heat-treated at a temperature 120° C. by the suction drum dryer method to provide a nonwoven fabric. The properties of the composite type heat-bondable fiber are shown in Table 1, and the properties of the nonwoven fabrics obtained are shown in Table 3.

As is clear from Table 3, in the case where the heat-bondable fiber of the present invention was mixed with another fiber to form a nonwoven fabric, there was obtained a nonwoven fabric whose tensile strength was high even if the amount of the heat-bondable fiber in the mixture was low because its high force of adhesion to other fibers and whose hand feels soft. In addition, a nonwoven fabric formed 100 percent of the heat-bondable fiber of the invention had high tensile strength and soft hand.

What is claimed is:

1. A nonwoven heat-bonded fabric consisting essentially of core-sheath type composite fibers having a core component covered by a sheath component;

said sheath component consisting of a copolymer of units of ethylene and at least one component selected from the group consisting of an unsaturated carboxylic acid, a derivative of said carboxylic acid, and an unsaturated carboxylic acid anhydride, said component being 0.1-5.0 mole percent, the melt index value of said copolymer polyethylene being 1-50g/10 minutes as measured by the ASTM D1238(E);

said core component consisting of a fiber-forming polymer having a melting point which is at least 30 degrees C higher than that of the copolymer of said sheath component, said fiber-forming polymer being one selected from the group consisting of polypropylene, nylon 6 and polyethylene terephthalate;

said nonwoven fabric being formed by forming said composite fibers into a web and heat bonding said composite fibers by heat treatment applied to said web at a temperature below said melting point of said core component, said heat-bonded nonwoven fabric having a tensile strength of at least 1,100g/3cm when the weight of said web is 15g/m$^2$, a uniform configuration retention of said composite fibers, a single fiber fineness of said composite fibers of less than 8 deniers, and a soft hand.

2. A nonwoven heat-bonded fabric consisting essentially of a mixture of at least 15 weight percent of core-sheath type composite fibers and not more than 85 weight percent of other fibers, said core-sheath type composite fibers having a core component covered by a sheath component;

said sheath component consisting of a copolymer of units of ethylene and at least one component selected from the group consisting of an unsaturated carboxylic acid, a derivative of said carboxylic acid, and an unsaturated carboxylic acid anhydride, said component being 0.1-5.0 mole percent, the melt index value of said copolymer polyethylene being 1-50g/10 minutes as measured by the ASTM D-1238(E);

said core component consisting of a fiber-forming polymer having a melting point which is at least 30 degrees C higher than that of the copolymer of said sheath component, said fiber-forming polymer being one selected from the group consisting of polypropylene, nylon 6 and polyethylene terephthalate;

said other fibers being selected from the group consisting of polypropylene, nylon 6, and polyethylene terephthalate;

said nonwoven fabric being formed by forming said composite fibers and other fibers into a web and heat bonding said composite fibers and other fibers by heat treatment applied to said web at a temperature below said melting point of said core component, said heat-bonded nonwoven fabric having a tensile strength of at least 415g/3cm when the weight of said web is 15g/m$^2$, a single fiber fineness of said composite fibers and said other fibers of less than 8 deniers, and a soft hand.

* * * * *

UNITED STATES PATENT AND TRADEMARK OFFICE

CERTIFICATE OF CORRECTION

PATENT NO. : 5,277,974

DATED : January 11, 1994

INVENTOR(S) : Eiichi Kubo et al.

It is certified that error appears in the above-identified patent and that said Letters Patent is hereby corrected as shown below:

Column 1, line 28 "30:" should read --30°C--

Column 1, line 62 "3013" should read --30°C--

Column 3, line 13 "Is" should read --is--

Column 4, line 60 "(9)" should read --(E)--

Column 4, line 64 "20t" should read --20°C--

Column 9, line 62 "96.213" should read --96.2°C--

Column 10, line 27 "110t" should read --110°C--

Signed and Sealed this

Thirtieth Day of August, 1994

*Attest:*

*Attesting Officer*

Bruce Lehman

BRUCE LEHMAN

*Commissioner of Patents and Trademarks*